US006455996B1

(12) United States Patent
Takagishi

(10) Patent No.: US 6,455,996 B1
(45) Date of Patent: Sep. 24, 2002

(54) CONVERGENCE CORRECTION DEVICE AND CATHODE-RAY TUBE USING SUCH CONVERGENCE CORRECTION DEVICE

(75) Inventor: Toshiya Takagishi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/468,811

(22) Filed: Dec. 22, 1999

(30) Foreign Application Priority Data

Dec. 28, 1998 (JP) ..... 10-374854
Mar. 24, 1999 (JP) ..... 11-080386

(51) Int. Cl.[7] ..... H01J 29/74
(52) U.S. Cl. ..... 313/433; 313/430; 313/431
(58) Field of Search ..... 313/412, 413, 313/422, 430, 431, 433

*Primary Examiner*—Vip Patel
(74) *Attorney, Agent, or Firm*—Rader, Fishman, & Grauer PLLC; Ronald P. Kananen, Esq.

(57) ABSTRACT

In a convergence correction device according to the present invention and a cathode-ray tube using such convergence correction device, a core having wound thereat a vertical correction coil (M/Dv) to which a vertical deflection current is applied is used while such core is being saturated. Also, such core might be made of a material having a characteristic in which a changed amount of a reactance per deflection velocity becomes less than a predetermined value. The above-mentioned predetermined value is less than 2000 $\mu$H/msec, for example. Thus, a convergence pattern, which is difficult to correct at the intermediate portions of upper and lower separated screens of a cathode-ray tube according to the related art, may be satisfactorily corrected without producing bright and dark stripes on the screen of the cathode-ray tube.

4 Claims, 4 Drawing Sheets

CONVERGENCE CORRECTION DEVICE AND CATHODE-RAY TUBE USING SUCH CONVERGENCE CORRECTION DEVICE

BACKGROUND OF THE INVENTION

1. Field of the Invention

The present invention generally relates to a convergence correction device for use with a cathode-ray tube apparatus and the like and a cathode-ray tube using such convergence correction device. More particularly, this invention relates to a convergence correction device using a modulation coil in which a core having wound thereat a coil to which a vertical deflection current is applied is used while the core is being saturated and in which the core around which the coil is wound is made of a material in which a changed amount of a reactance per deflection velocity becomes less than a predetermined value so that a convergence pattern, which is difficult to correct at the intermediate portions of upper and lower separated screens of a cathode-ray tube (hereinafter simply referred to as "intermediate portions") according to the related art, may be corrected satisfactorily.

2. Description of the Related Art

A convergence characteristic is known as one of important characteristics of a deflection yoke. As a deflection angle of a cathode-ray tube increases and a thickness of a screen of a cathode-ray tube decreases recently, the adjustment of convergence becomes very difficult. In such a case, there are employed convergence correction coils. A modulation coil which applies a saturable-core reactor is available as one of the above-mentioned convergence correction coils. A horizontal deflection current and a vertical deflection current are applied to this modulation coil.

However, when the saturable core having wound thereat the coil to which the vertical deflection current is applied is used while the saturable core is being saturated, there arises a risk that a phenomenon in which bright and dark stripes are produced on the screen of a cathode-ray tube as shown in FIG. 1 will occur. This phenomenon occurs in the saturable core having the characteristic in which the reactance of the saturable core is fluctuated suddenly in a period during which the saturable core is switched from the unsaturated area to the saturated area. This phenomenon occurs such that, when the reactance of the saturable core is fluctuated suddenly, the velocity modulation of the vertical deflection current occurs, thereby resulting in the sweep being fluctuated. Since the reactance value of the core is influenced by a value of a frequency of a current, the above-mentioned phenomenon becomes remarkable in a television set in which a vertical deflection frequency is twice the ordinary vertical deflection frequency (100 Hz).

SUMMARY OF THE INVENTION

It is an object of the present invention to provide a convergence correction device in which a core having wound thereat a coil to which a vertical deflection current is applied is used while the core is being saturated and in which the core around which the vertical correction coil is wound is made of a material having a characteristic in which a changed amount of a reactance per deflection velocity becomes less than a predetermined value so that a convergence pattern, which is difficult to correct at the intermediate portions according to the related art, may be corrected satisfactorily.

According to an aspect of the present invention, there is provided a convergence correction device which is comprised of a first core around which a first coil connected to a vertical deflection coil in series is wound, a pair of second cores disposed on one end of the first core and around which a second coil connected to an upper horizontal deflection coil in series is wound, a pair of third cores disposed on the other end of the first core and around which a third coil connected to a lower horizontal deflection coil in series is wound, and a pair of magnets for respectively applying magnetic biases to the second and third cores, wherein the first core is used while it is being saturated so that an amount of magnetic flux generated in the first coil may not increase from a middle stage of a vertical deflection current and the first core is made of a material having a characteristic in which a changed amount of a reactance per deflection velocity becomes less than a predetermined value in which a vertical deflection current may not be suddenly changed by transient phenomena.

According to another aspect of the present invention, a cathode-ray tube of the present invention includes the convergence correction device which has the above-mentioned arrangement and the above-mentioned actions. Then, the first core is used while it is being saturated so that an amount of magnetic flux generated in the first coil may not increase from the middle stage (i.e. intermediate portions) of the vertical deflection position on the screen of a cathode-ray tube and the first core is made of a material having a characteristic in which a changed amount of a reactance per deflection velocity becomes less than a predetermined value in which a vertical deflection current may not be suddenly changed by transient phenomena.

According to the present invention, the convergence pattern, which becomes difficult to correct at the intermediate portions as the deflection angle of the cathode-ray tube increases and the thickness of the screen of the cathode-ray tube decreases, may be satisfactorily corrected without producing bright and dark stripes on the screen.

DESCRIPTION OF THE PREFERRED EMBODIMENT

The present invention will be described below with reference to the drawings.

Figure 2A:
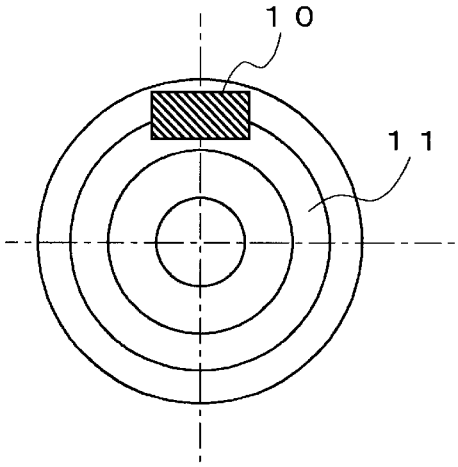
FIG. 2A is a rear view showing a deflection yoke having an inventive convergence correction device attached thereto from the necked-down portion of a cathode-ray tube.
Figure 2B:
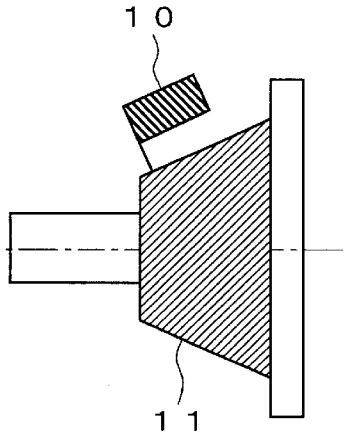
FIG. 2B is a side view of the deflection yoke having the inventive convergence correction device attached thereto.

FIG. 2A is a rear view showing a deflection yoke having an inventive convergence correction device attached thereto from the necked-down portion of a cathode-ray tube. FIG. 2B is a side view showing the deflection yoke with the inventive convergence correction device attached thereto. As shown in FIGS. 2A and 2B, a modulation coil unit 10 which is served as "convergence correction device" is disposed on the upper portion of a core 11. Throughout the specification and the accompanying drawings, the modulation coil unit 10 will hereinafter be simply referred to as "M/D unit 10".

Figure 3:
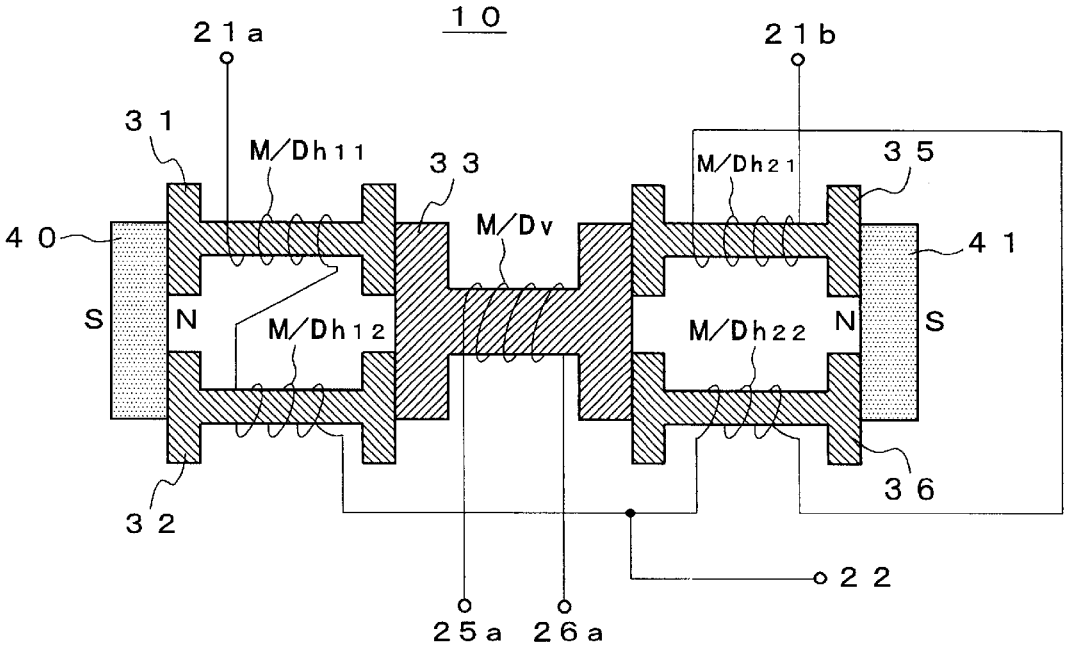
FIG. 3 is a diagram showing a modulation coil unit.

FIG. 3 shows the arrangement of the M/D unit 10.

As shown in FIG. 3, the M/D unit 10 comprises two pairs of cores 31, 32 and 35, 36 disposed across a center core 33 with a predetermined interval and bias magnets 40, 41 for magnetic bias disposed on one side of each of the two pairs of the cores 31, 32 and 35, 36.

Horizontal correction coils M/Dh11, M/Dh12 and M/Dh21, M/Dh22 are wound around the cores 31, 32 and 35, 36, respectively. A vertical correction coil M/Dv is wound around the core 33 located at the center of the M/D unit 10. The connection of respective elements in the M/D unit 10 will be described concretely below.

Figure 4:
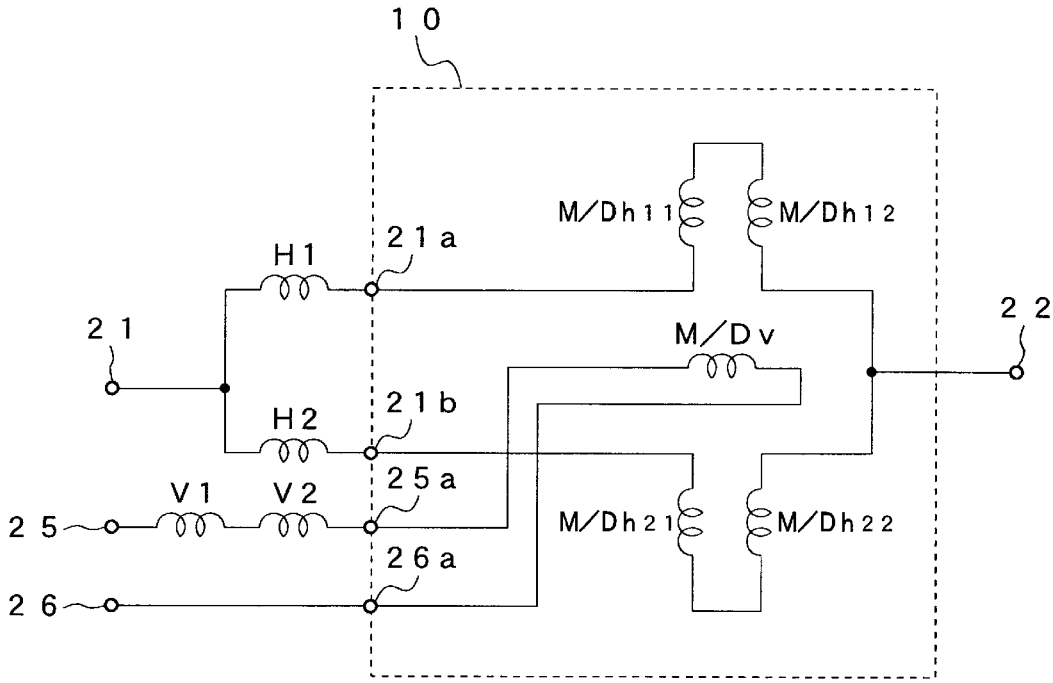
FIG. 4 is a diagram showing an equivalent circuit of the convergence correction device.

FIG. 4 shows an equivalent circuit of the convergence correction device (i.e. M/D unit 10). A phantom block shown by a broken line in FIG. 4 corresponds to the M/D unit 10 shown in FIG. 3. As shown in FIG. 4, horizontal deflection coils H1, H2 are connected in parallel to terminals 21, 22 to which a horizontal deflection current is applied. The horizontal deflection coils H1, H2 have connected thereto the horizontal correction coils M/Dh1, M/Dh12 and M/Dh21, M/Dh22, each pair of which form one set.

As shown in FIG. 4, the horizontal correction coils M/Dh11, M/Dh12 are connected in series, similarly, and the horizontal correction coils M/Dh21, M/Dh22 are connected in series, which are then connected to the corresponding horizontal deflection coils H1, H2, respectively.

As shown in FIG. 4, vertical deflection coils V1, V2 which are connected in series, are connected between terminals 25 and 26. A vertical correction coil M/Dv comprising the M/D unit 10 is connected to the vertical deflection coils V1, V2 in series. Vertical deflection currents are applied to the above-mentioned terminals 25, 26.

An operation of this equivalent circuit will be described next with reference to FIGS. 3 and 4. In a period during which the vertical deflection currents flowing through the terminals 25, 26 are zero, the cores 31, 32, 35, 36 wound around the horizontal correction coils M/Dh are nearly saturated by magnetic fields of the bias magnets 40, 41. When the vertical deflection current flows in the upper deflection direction, a magnetic field corresponding to the vertical deflection current is generated in the vertical correction coil M/Dv connected in series to the vertical deflection coils V1, V2. In the right-hand side of FIG. 3, since a magnetic field generated from the vertical correction coil M/Dv and the magnetic field generated from the bias magnet 41 are repelled with each other, the saturated cores of the horizontal correction coils M/Dh21, M/Dh22 arranged between the vertical correction coil M/Dv and the bias magnet 41 are canceled and their reactances increase.

On the other hand, in the left-hand side of FIG. 3, the magnetic field from the vertical correction coil M/Dv and the magnetic field from the bias magnet 40 are added to each other with the result that the cores 31, 32, 35, 36 are saturated much more. As a consequence, the reactances of the cores 31, 32 of the horizontal correction coils M/Dh11, M/Dh12 on the left-hand side of FIG. 3 are further decreased.

Figure 5:
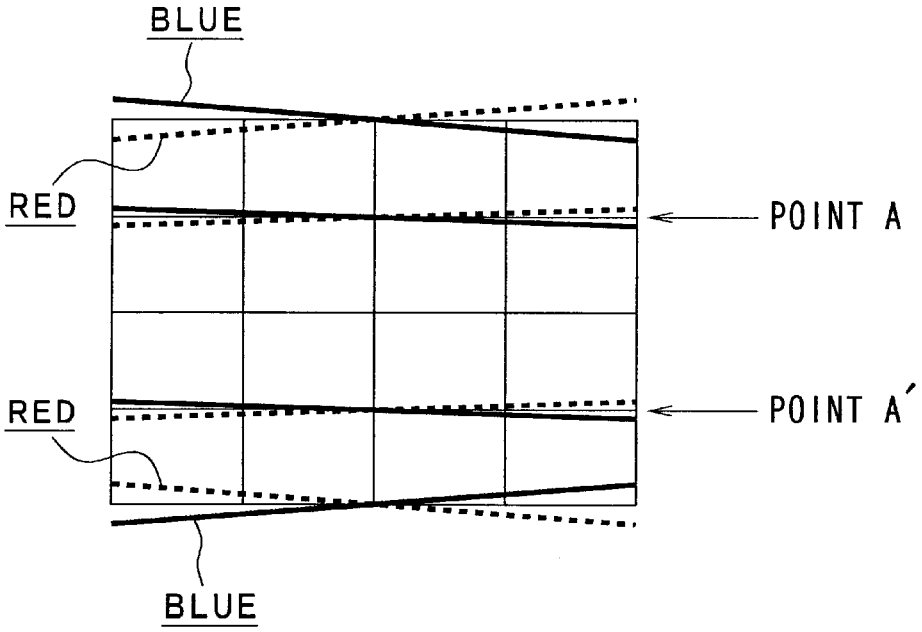
FIG. 5 is a diagram useful for explaining convergence correction patterns on the upper and lower portions of the screen of the cathode-ray tube.

The aforementioned operation is inverted as the vertical deflection current is inverted. Therefore, when the magnitude of the vertical deflection current and the direction of the current are changed, the reactances of the horizontal correction coils M/Dh11, M/Dh12 and M/Dh21, M/Dh22 connected in series to the horizontal deflection coils H1, H2 are operated differentially. Since the reactances of the horizontal correction coils M/Dh11, M/Dh12 and M/Dh21, M/Dh22 are changed as described above, the horizontal deflection coils H1, H2 cause the horizontal deflection current to flow differentially in the circuit shown in FIG. 4, thereby resulting in a convergence correction pattern shown in FIG. 5 being obtained.

Figure 6:
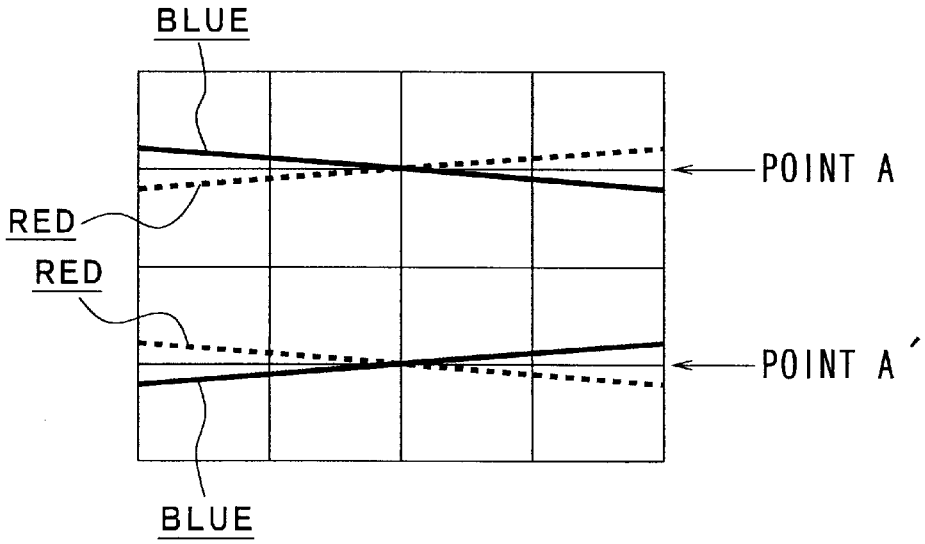
FIG. 6 is a diagram useful for explaining convergence correction patterns on the middle stage of the screen of the cathode-ray tube.

A convergence correction amount acts on the magnetic flux amount generated from the vertical correction coil M/Dv based on the vertical deflection current. Therefore, by saturating this magnetic flux amount from the middle stage of the vertical deflection current, a convergence correction pattern shown in FIG. 6 becomes possible. The expression "middle stage of vertical deflection current" represents a portion close to the center between a peak point and a current zero point shown in FIG. 7. The expression "intermediate portions" represents each of center points A and A' of upper and lower separated screens of the cathode-ray tube as shown in FIG. 6. According to the present invention, when the vertical deflection current is saturated from the middle stage, unlike the related-art convergence correction pattern in which the convergence pattern is changed linearly relative to the deflection current as shown by the points A, A' in FIG. 5, the convergence correction pattern in which the middle stages of the magnetic flux amount relative to the deflection current increase becomes possible. In other words, by combining the convergence correction device according to the present invention with the deflection yoke, it becomes possible to execute the convergence correction only at the center points A, A'.

In the above-mentioned embodiment, as the core 33 around which the vertical correction coil M/Dv is wound, there may be used such a core in which the changed amount of the reactance of the core 33 per deflection velocity is less than a certain predetermined value, e.g. less than 2000 $\mu$H/msec.

Figure 1:
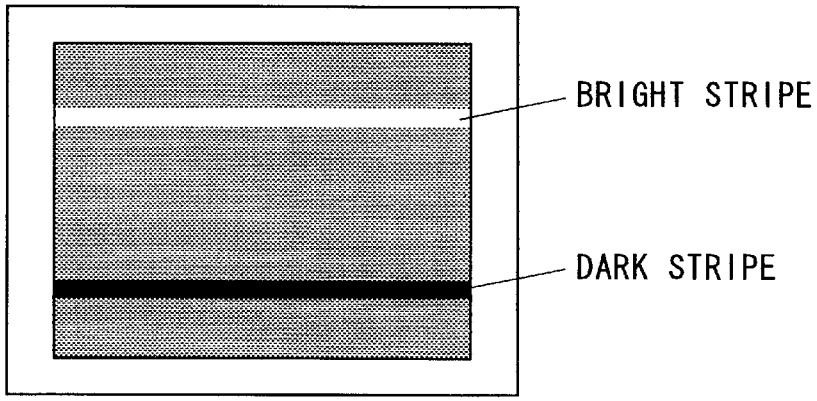
FIG. 1 (RELATED ART)
FIG. 1 is a diagram used to explain bright and dark stripes displayed on the screen of a cathode-ray tube.

The reason for this is to prevent the phenomenon in which horizontal bright and dark stripes from being produced on the screen of the cathode-ray tube as shown in FIG. 1 when the core is saturated in use. This phenomenon occurs such that, in the period during which the core is saturated from the unsaturated area, the reactance of the core is fluctuated suddenly so that the velocity modulation of the vertical deflection current occurs, thereby resulting in the sweeping being fluctuated.

Therefore, according to the embodiment of the present invention, the core of the present invention might be made of a material having a characteristic in which the changed amount of the reactance of the core per deflection velocity is less than 2000 $\mu$H/msec. The manner in which the changed amount of the reactance of the core per deflection velocity is calculated will be described next.

Figure 7:
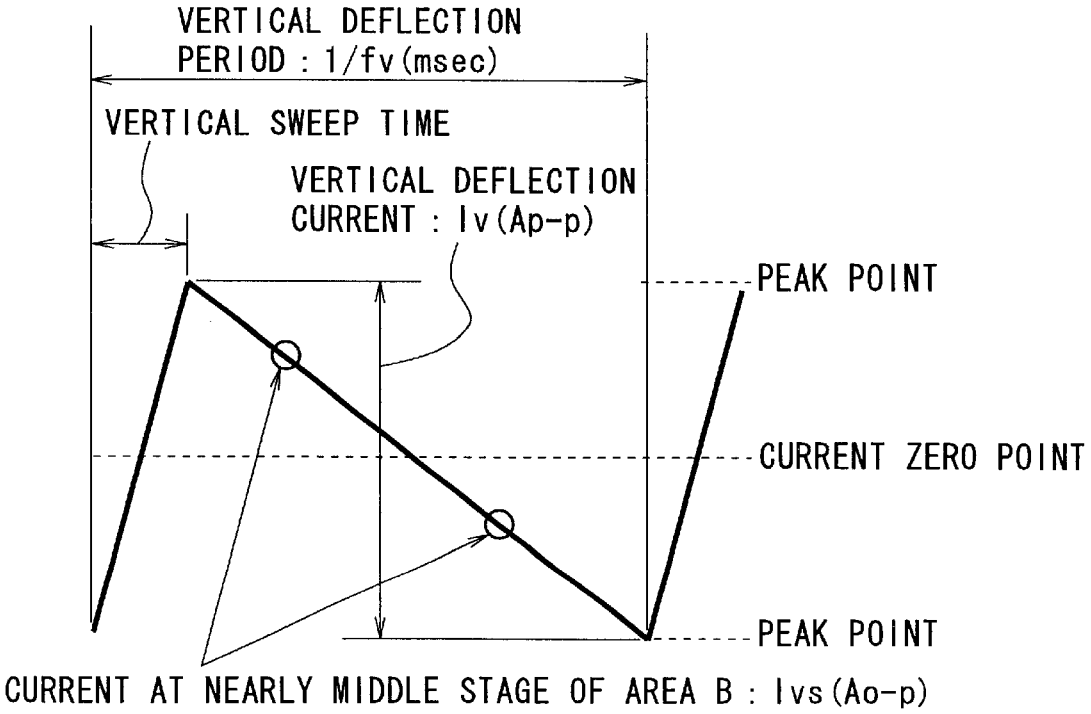
FIG. 7 is a diagram showing a vertical deflection current.

FIG. 7 is a diagram showing a vertical deflection current Iv. In FIG. 7, the vertical axis represents the magnitude of the vertical deflection current Iv whose unit is [A]. The horizontal axis in FIG. 7 represents the time axis, and 1/fv represents the vertical deflection period (e.g. 1/60 second or 1/100 second). A value shown by a broken-line in FIG. 7 represents the current zero point, and the upper side from this zero point acts on the deflection of the upper portion of the screen of the cathode-ray tube. Moreover, the lower portion from the current zero point acts on the deflection of the lower portion of the screen of the cathode-ray tube. An intermediate point between the upper and lower peak values and the current zero point shown in FIG. 7 corresponds to Ivs shown in the following graph of FIG. 8.

Figure 8:
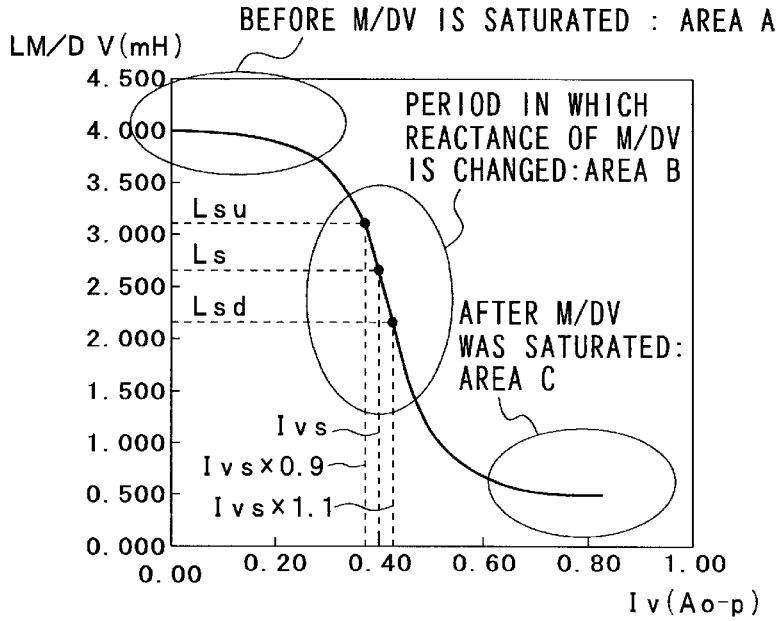
FIG. 8 is a characteristic graph graphing reactance characteristics of the core.

FIG. 8 shows saturation characteristics of a certain core material. In FIG. 8, the horizontal axis represents the vertical deflection current Iv [A], and represents the current obtained between the current zero point and the peak values. Also, the vertical axis in FIG. 8 represents the core reactance LM/DV [mH]. As shown in FIG. 8, the reactance of the core material is changed in response to the magnitude of the vertical deflection current. In FIG. 8, the area A represents the state obtained before the core is saturated, and the area C represents the state obtained when the core is saturated. Further, in FIG. 8, the area B represents the period during which the reactance of the core is changed between the area A and the area C.

The changed amount (M/DVL) of the reactance of the core per deflection velocity is calculated by using the following equation (1):

$$M/DVL[\mu H/\text{msec}]=(Lsu-Lsd)/(1/fv\times(1.1Ivs-0.9Ivs)/Iv)[\mu H/\text{msec}] \quad (1)$$

where Iv [Ap-p] represents the vertical deflection current, Ivs [A] represents the current obtained at nearly the center of the area B, Lsu [$\mu$H] represents the reactance obtained when the current is at 1.1Ivs, Lsd [$\mu$H] represents the reactance obtained when the current is at 0.9Ivs, and fv [Hz] represents the vertical deflection frequency.

That is, the changed amount M/DVL of the reactance of the core per deflection velocity is obtained by dividing the difference (Lsu-Lsd) between the reactance obtained when the vertical deflection current is at 90% value and the reactance obtained when the vertical deflection current is at 110% value with respect to the current Ivs at nearly the center of the area B shown in FIG. 8 with a time necessary for such change. When the value thus calculated is large, this means that the changing ratio per deflection velocity is large. As a consequence, the reactance of the core is changed suddenly so that the vertical deflection current is fluctuated, thereby resulting in the bright and dark stripes being produced on the screen of the cathode-ray tube as shown in FIG. 1. Therefore, according to this embodiment, as the material of the core, there might be used such material having the characteristic in which the changed amount M/DVL of the reactance per deflection velocity is less than 2000 $\mu$H/msec for example.

As described above, according to the present invention, the core having wound thereat the vertical correction coils to which the vertical deflection current is applied is used while the core is being saturated. Also, the material of the core around which the vertical correction coil is wound might be the material having the characteristic in which the changed amount of the reactance per deflection velocity becomes less than 2000 $\mu$H/msec. Thus, the convergence pattern, which is difficult to correct at the intermediate portions in the related art, may be corrected without producing bright and dark stripes on the screen of the cathode-ray tube.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A convergence correction device comprising:

a first core around which a first coil connected to a vertical deflection coil in series is wound;

a pair of second cores disposed on one end of said first core and around which a second coil connected to an upper horizontal deflection coil in series is wound;

a pair of third cores disposed on the other end of said first core and around which a third coil connected to a lower horizontal deflection coil in series is wound; and a pair of magnets for respectively applying magnetic biases to said second and third cores, wherein said first core is used while it is being saturated so that an amount of magnetic flux generated in said first coil may not increase from a middle stage of a vertical deflection current and said first core is made of a material having a characteristic in which a changed amount of a reactance per deflection velocity becomes less than a predetermined value in which a vertical deflection current may not be suddenly changed by transient phenomena.

2. A convergence correction device as claimed in claim 1, wherein said predetermined value is less than 2000 $\mu$H/msec.

3. A cathode-ray tube using a convergence correction device, said convergence correction device comprising:

a first core around which a first coil connected to a vertical deflection coil in series is wound;

a pair of second cores disposed on one end of said first core and around which a second coil connected to an upper horizontal deflection coil in series is wound;

a pair of third cores disposed on the other end of said first core and around which a third coil connected to a lower horizontal deflection coil in series is wound; and a pair of magnets for respectively applying magnetic biases to said second and third cores, wherein said first core is used while it is being saturated so that an amount of magnetic flux generated in said first coil may not increase from the middle stage of the vertical deflection position on the screen of a cathode-ray tube and said first core is made of a material having a characteristic in which a changed amount of a reactance per deflection velocity becomes less than a predetermined value in which a vertical deflection current may not be suddenly changed by transient phenomena.

4. A cathode-ray tube as claimed in claim 3, wherein said predetermined value is less than 2000 $\mu$H/msec.

* * * * *